US011114028B2

(12) United States Patent
Yoon et al.

(10) Patent No.: US 11,114,028 B2
(45) Date of Patent: Sep. 7, 2021

(54) ORGANIC LIGHT-EMITTING DISPLAY DEVICE

(71) Applicant: LG Display Co., Ltd., Seoul (KR)

(72) Inventors: Munchae Yoon, Paju-si (KR); Sungwon Lee, Daegu (KR); Sungwook Choi, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/716,125

(22) Filed: Dec. 16, 2019

(65) Prior Publication Data

US 2020/0193905 A1 Jun. 18, 2020

(30) Foreign Application Priority Data

Dec. 17, 2018 (KR) ..... 10-2018-0163450
Aug. 14, 2019 (KR) ..... 10-2019-0099633

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0842* (2013.01); *G09G 2310/0294* (2013.01); *G09G 2310/0297* (2013.01); *G09G 2320/0233* (2013.01)

(58) Field of Classification Search
None
See application file for complete search history.

(56) References Cited

U.S. PATENT DOCUMENTS 10,373,553 B2 * 8/2019 Shin ..... G09G 3/3233
2009/0213049 A1 * 8/2009 McCreary ..... G09G 3/3291 345/80
2011/0279444 A1 * 11/2011 Chung ..... G09G 3/3233 345/214
2012/0293478 A1 * 11/2012 Chaji ..... G09G 3/3266 345/212
2014/0028535 A1 * 1/2014 Min ..... G09G 3/3655 345/87
2016/0012798 A1 * 1/2016 Oh ..... G09G 3/325 345/205
2016/0163255 A1 * 6/2016 Kim ..... G09G 3/3291 345/212
2019/0051250 A1 * 2/2019 Lee ..... G09G 3/3266
2020/0074931 A1 * 3/2020 Yang ..... G09G 3/3266

* cited by examiner

*Primary Examiner* — Nitin Patel
*Assistant Examiner* — Amen W. Bogale
(74) *Attorney, Agent, or Firm* — Seed IP Law Group LLP

(57) ABSTRACT

The present disclosure provides a display device capable of determining the characteristics of the light emitting diode without having to consider various factors dependent upon the manufacturing process. The light emitting diode includes an internal resistor and a parasitic capacitor. The light emitting diode is connected to a sensing circuit including an integrator that has a sensing resistor and a feedback capacitor. Based on a first sensing of a pixel along a first sensing path and a second sensing of the pixel along the second sensing path, the sensing circuit senses a first charge amount from the first sensing path and a second charge amount from the second sensing path. The characteristics of the light emitting diode can be determined by dividing the first charge amount and the second charge amount, which is based on the ratio of the sensing resistor and the internal resistor.

20 Claims, 12 Drawing Sheets

ORGANIC LIGHT-EMITTING DISPLAY DEVICE

CROSS-REFERENCE TO RELATED APPLICATION(S)

This application claims the benefit of Korea Patent Application No. 10-2018-0163450 filed on Dec. 17, 2018, and Korea Patent Application No. 10-2019-0099633 filed on Aug. 14, 2019, which are incorporated herein by reference for all purposes as if fully set forth herein.

BACKGROUND

Technical Field

The present document relates to an organic light-emitting display device.

Description of the Related Art

An organic light-emitting display device of an active matrix type includes an organic light-emitting diode (hereinafter referred to as an "OLED") that emits light autonomously, and has advantages of fast response speed, high emission efficiency and brightness, and a large viewing angle.

An organic light-emitting display device has pixels, each one including an OLED, arranged in a matrix form and controls the brightness of the pixels based on the gray scale of image data. Each of the pixels includes a driving thin film transistor (TFT) configured to control a driving current flowing into its OLED in response to a voltage applied between its gate electrode and source electrode (hereinafter referred to as a "gate-source voltage"), and controls the brightness of an image based on the amount of emission of the OLED proportional to the driving current.

An OLED may have a different operating point voltage due to variations that occur in each manufacturing process run, sometimes called process deviation. Furthermore, the OLED has an operating point voltage shifted according to a lapse of the emission time and has a deterioration characteristic in which emission efficiency is reduced. The OLED operating point voltage may be different for each pixel depending on the process deviation for that particular run or deterioration characteristic. If pixels have different OLED driving characteristics, an image sticking phenomenon may occur due to a brightness deviation.

BRIEF SUMMARY

In order to compensate for picture quality degradation attributable to a brightness deviation, there has been known a compensation technology for sensing an OLED driving characteristic and modulating digital image data based on a corresponding sensing value. In the conventional compensation technology, the OLED driving characteristic is sensed using a characteristic in which parasitic capacitance of an OLED is different depending on a process or deterioration characteristic. That is, in the conventional compensation technology, when a driving current flows into an OLED, the amount of charges Qsen accumulated in the parasitic capacitor of the OLED is sensed. The size of an operating point of the OLED is determined based on the amount of sensed charges (Vsen=Qsen/Cout) (wherein Vsen is an output voltage of an integrator, and Cout is feedback capacitance of the integrator).

However, a change in the amount of charges Qsen of the OLED does not depend only on a change in the parasitic capacitance of the OLED. The amount of charges Qsen of the OLED may further vary depending on the electron mobility of a driving TFT generating a driving current, a source electrode voltage of the driving TFT, the charging and discharging characteristics of a storage capacitor connected to the gate electrode and source electrode of the driving TFT, the configuration of a pixel circuit, etc. In the conventional compensation technology, it is difficult to precisely sense an OLED driving characteristic due to an unstable sensing value because the amount of charges Qsen of an OLED is changed by various factors as described above.

Accordingly, the further improved aspect of the present disclosure provides a precise way of sensing the driving characteristic of an OLED in the pixel of an organic light-emitting display device. For example, the present disclosure provides deriving a driving characteristic value of the OLED based on a sensing resistor Rsen connected to a current integrator and a parasitic resistance of the OLED Roled. The accuracy of sensing is greatly improved by the present disclosure because the driving characteristic value of the OLED which is based on "Roled/(Rsen+Roled)" is not affected by other circuit elements or any varying factors involved during the manufacturing process.

BRIEF DESCRIPTION OF THE SEVERAL VIEWS OF THE DRAWINGS

The accompanying drawings, which are included to provide a further understanding of the present disclosure and are incorporated in and constitute a part of the disclosure, exemplarily represent embodiments of the disclosure and together with the description serve to explain the principles of the disclosure. In the drawings.

DETAILED DESCRIPTION

Figure 1:
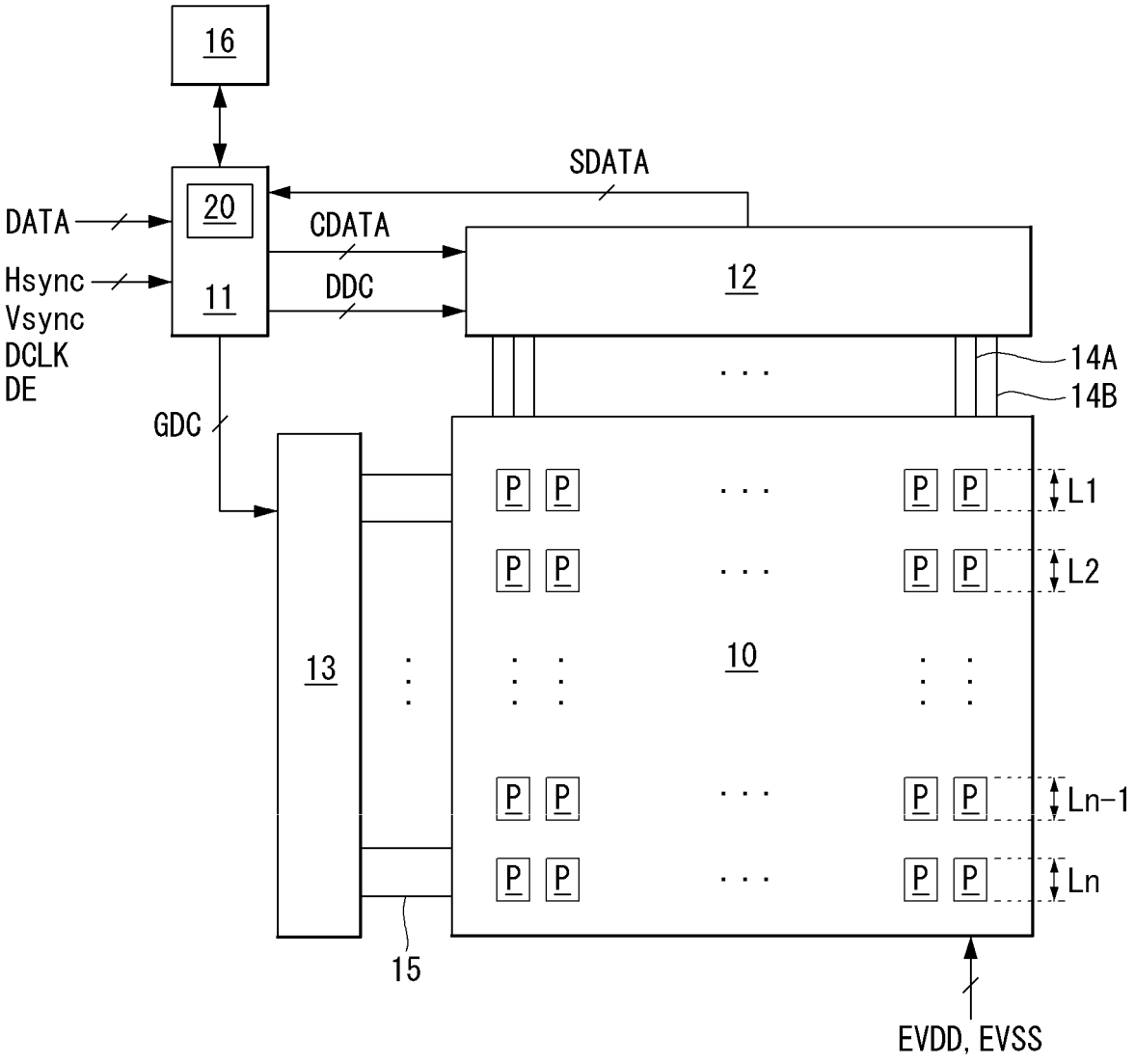
FIG. 1 is a block diagram showing an organic light-emitting display device according to an embodiment of the present disclosure.

The merits and characteristics of this specification and a method for achieving the merits and characteristics will become more apparent from the embodiments described in detail in conjunction with the accompanying drawings. However, the present disclosure is not limited to the disclosed embodiments, but may be implemented in various different ways. The embodiments are provided to allow those skilled in the art to understand the category of the present disclosure. The disclosure is defined by the category of the claims. The same reference numerals will be used to refer to the same or similar elements throughout the drawings.

A shape, size, ratio, angle, and number disclosed in the drawings for illustrating embodiments of the present disclosure are illustrative, and thus the present disclosure is not limited to contents shown in the present disclosure. Throughout the specification, the same reference numeral denotes the same element. If a term, such as "include (or comprise)", "have" or "formed of" is mentioned in this specification, another part may be added unless "~only" is used. If an element is expressed in the singular form, it includes a case where the element is a plural form unless specially described otherwise.

In interpreting an element, the interpretation is construed as including an error range unless explicitly described otherwise separately.

In the case of a description regarding a location relation, for example, if the location relation between two parts is described using "on~", "above (or over)~", "under (or below)~", "connect", "coupled to~" or "adjacent to~", "next to~", for example, one or more parts may be positioned between the two parts unless a term, such as "right" or "directly", is used.

The first, the second, etc., may be used to describe various elements, but the elements are not restricted by the terms. The terms are used to only distinguish one element from the other element. Accordingly, a first element to be described hereunder may be a second element within the technical spirit of the present disclosure.

In the present disclosure, a pixel circuit formed on the substrate of a display panel may be implemented as a TFT having an n type metal oxide semiconductor field effect transistor (MOSFET) structure or may be implemented as a TFT having a p type MOSFET structure. The TFT is a 3-electrode device including a gate, a source and a drain. The source is an electrode supplying carriers to the transistor. The carrier starts to flow from the source within the TFT. The drain is an electrode from which the carrier within the TFT exits to the outside. That is, the carrier flows from the source to the drain within the MOSFET. In the case of an n type TFT (NMOS), a source voltage is lower than a drain voltage so that electrons can flow from the source to the drain because carriers are electrons. In the n type TFT, an electric current flows from the drain to the source because electrons flow from the source to the drain. In contrast, in the case of a p type TFT (PMOS), a source voltage is higher than a drain voltage so that holes can flow from the source to the drain because carriers are holes. In the p type TFT, an electric current flows from the source to the drain because holes flow from the source to the drain. It is to be noted that the source and drain of the MOSFET are not fixed. For example, the source and drain of the MOSFET may be changed depending on an applied voltage.

In the present disclosure, the semiconductor layer of a TFT may be implemented by at least any one of an oxide element, an amorphous silicon element or a polysilicon element.

Hereinafter, embodiments of the present disclosure are described in detail with reference to the accompanying drawings. In the following description, a detailed description of a known function or element related to the present disclosure is omitted if it is determined that the detailed description unnecessarily makes the gist of the present disclosure vague.

Figure 2:
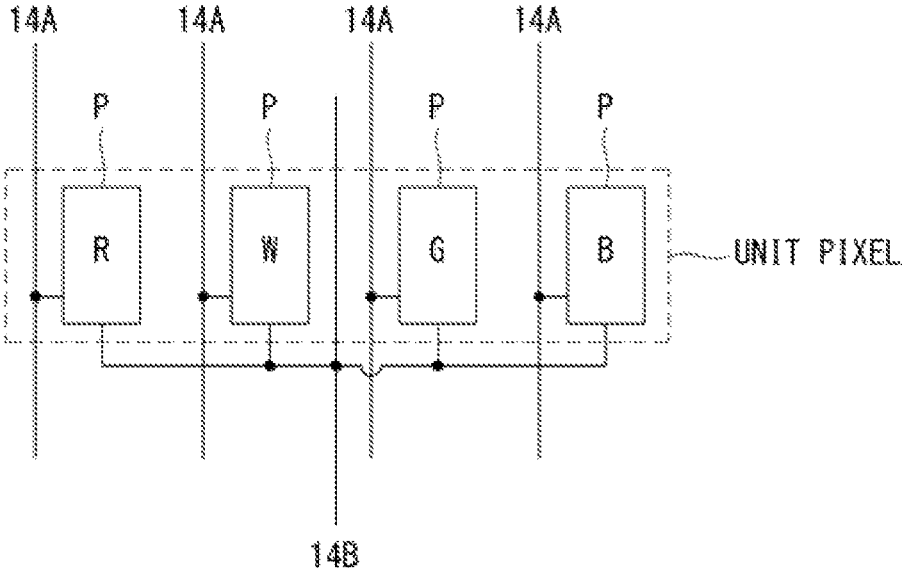
FIG. 2 is a diagram showing an example in which a sensing line and unit pixels are connected.
Figure 3:
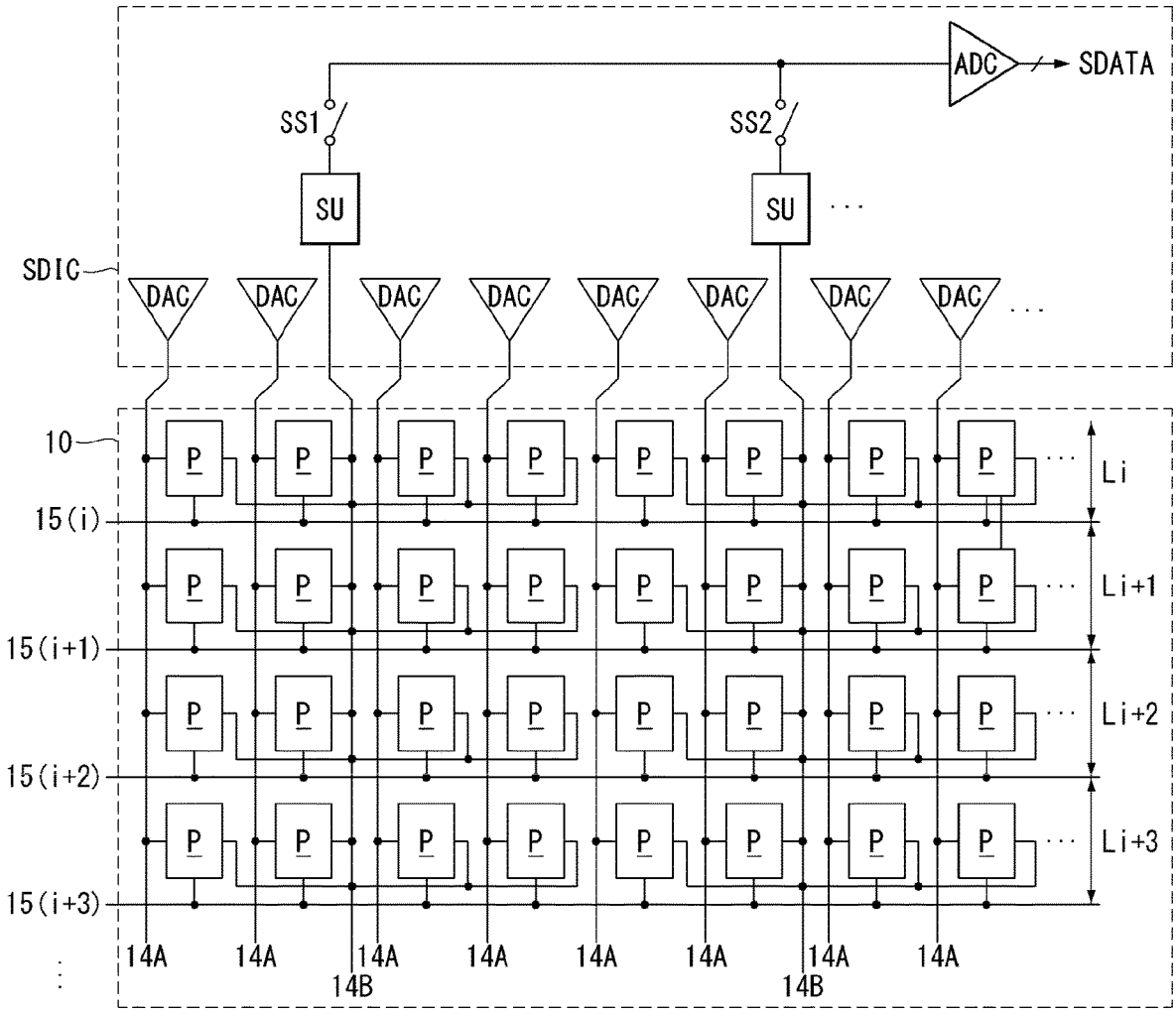
FIG. 3 is a diagram showing an example of the configuration of a pixel array and a data driver IC.

FIG. 1 is a block diagram showing an organic light-emitting display device according to an embodiment of the present disclosure. FIG. 2 is a diagram showing an example in which a sensing line and unit pixels are connected. FIG. 3 is a diagram showing an example of the configuration of a data driver connected to a pixel array of FIG. 2.

Referring to FIGS. 1 to 3, the organic light-emitting display device according to an embodiment of the present disclosure includes a display panel 10, a timing controller 11, a pixel sensing device, and memory 16. The pixel sensing device according to an embodiment of the present disclosure includes a sensing unit SU and a compensation unit 20. The pixel sensing device according to an embodiment of the present disclosure may further include a panel driving unit configured with a data driver 12 and a gate driver 13.

In the display panel 10, a plurality of data lines 14A and sensing lines 14B and a plurality of gate lines 15 are overlapped. Pixels P are disposed adjacent to respective overlapping areas in a matrix form.

Two or more pixels P connected to different data lines 14A may share the same sensing line 14B and the same gate line 15. For example, as in FIG. 2, an R pixel for red display, a W pixel for white display, a G pixel for green display, and a B pixel for blue display that are adjacent to one another horizontally and connected to the same gate line 15 may be connected to one common sensing line 14B. A sensing line sharing structure in which one sensing line 14B is assigned to every plural pixel columns as described above can easily secure the open ratio of a display panel. In the sensing line structure, each sensing line 14B may be positioned every plural data lines 14A. In these drawings, the sensing line 14B has been illustrated as being parallel to the data line 14A, but may be positioned to cross the data line 14A.

In one embodiment, the R pixel, W pixel, G pixel, and B pixel may configure a single unit pixel as in FIG. 2. However, in another embodiment, a unit pixel may be configured with an R pixel, a G pixel, and a B pixel.

Each pixel P is supplied with a high potential pixel voltage EVDD and a low potential pixel voltage EVSS from a power generator. The pixel P according to an embodiment of the present disclosure may have a structure suitable for sensing a driving characteristic deviation of a light-emitting device according to a process deviation. Furthermore, the pixel P according to an embodiment of the present disclosure may have a structure suitable for sensing a driving characteristic deviation of a light-emitting device according to environment conditions, such as a driving time lapse and/or a panel temperature. The configuration of the pixel P circuit may be modified in various ways. For example, the pixel P may include a plurality of switch elements and at least one storage capacitor in addition to a light-emitting device and a driving element.

The timing controller 11 may implement sensing driving and display driving according to a predetermined control sequence. In this case, the sensing driving is driving for sensing a driving characteristic (e.g., operating point voltage) of the light-emitting device and updating a corresponding compensation value. The display driving is driving for reproducing an image by writing correction image data CDATA into which a compensation value has been incorporated in the display panel 10. Sensing driving may be performed in a booting period before display driving starts or may be performed in a power-off period after display driving is terminated under the control of the timing controller 11. The booting period means a period until a screen is turned on after system power is applied. The power-off period means a period until system power is released after a screen is turned off.

The sensing driving may be performed in the state in which only a screen of a display device has been turned off while system power is applied, for example, in a standby mode, a sleep mode, a low power mode, etc. The timing controller 11 may sense a standby mode, a sleep mode, a low power mode, etc., in a predetermined sensing process, and may control an overall process for sensing driving.

The timing controller 11 may generate a data timing control signal DDC for controlling operating timing of the data driver 12 and a gate timing control signal GDC for controlling operating timing of the gate driver 13 based on timing signals, such as a vertical sync signal Vsync, a horizontal sync signal Hsync, a dot clock signal DCLK and a data enable signal DE received from a host system. The timing controller 11 may differently generate the timing control signals DDC and GDC for display driving and the timing control signals DDC and GDC for sensing driving.

The gate timing control signal GDC includes a gate start pulse, a gate shift clock, etc. The gate start pulse is applied to a gate stage that generates the first output, and controls the gate stage. The gate shift clock is a clock signal input to gate stages in common and is a clock signal for shifting a gate start pulse.

The data timing control signal DDC includes a source start pulse, a source sampling clock, a source output enable signal, etc. The source start pulse controls data sampling start timing of the data driver 12. The source sampling clock is a clock signal that controls sampling timing of data based on a rising or falling edge. The source output enable signal controls output timing of the data driver 12.

The timing controller 11 may have the compensation unit 20 embedded therein.

The compensation unit 20 receives sensing result data SDATA, indicative of a driving characteristic of a light-emitting device, from the sensing unit SU. In one or more embodiments, the sensing can occur twice per pixel when sensing driving is performed. However, in other embodiments, different number of sensing can be performed during the sensing driving (e.g., once per pixel, three times per pixel, etc.). The compensation unit 20 derives a driving characteristic value of a light-emitting device for each pixel based on the first sensing result data and the second sensing result data. For example, the first sensing result data corresponds to a first sensing output voltage (refer to Vsen1 of FIG. 8) and the second sensing result data corresponds to a second sensing output voltage (refer to Vsen2 of FIG. 8). In one embodiment, the compensation unit 20 derives a driving characteristic value of a light-emitting device for each pixel based on the ratio between the first sensing result data and the second sensing result data. For example, the compensation unit 20 derives a driving characteristic value of a light-emitting device for each pixel by dividing the second sensing result data (Vsen2 of FIG. 8) by the first sensing result data (Vsen1 of FIG. 8). If the two sensing result data is divided as described above, a driving characteristic value of a light-emitting device may be determined regardless of the amount of charges accumulated in the parasitic capacitor of the light-emitting device. That is, the accuracy of sensing can be significantly improved because the driving characteristic value of the light-emitting device is determined by (an internal resistance value of the light-emitting device)/(sensing resistor value+internal resistance value of the light-emitting device). Further detail of deriving the driving characteristic value will be explained throughout the present disclosure.

The compensation unit 20 calculates a compensation value capable of compensating for a brightness deviation attributable to a process deviation or deterioration deviation of a light-emitting device (e.g., a shift of an operating point voltage) based on a derived driving characteristic value of the light-emitting device, and stores the compensation value in the memory 16. The compensation value stored in the memory 16 may be updated whenever a sensing operation is repeated. The compensation unit 20 can easily compensate for a brightness deviation attributable to a difference in the characteristic of a light-emitting device by correcting the data DATA of an input image based on a compensation value read from the memory 16 and supplying corrected image data CDATA to the data driver 12 when display driving is performed.

The data driver 12 includes at least one data driver integrated circuit (IC) SDIC. A digital-analog converter (hereinafter referred to as a "DAC") connected to each data line 14A is embedded in the data driver IC SDIC.

When display driving is performed, the DAC converts correction image data CDATA into a data voltage for display in response to a data timing control signal DDC applied by the timing controller 11, and supplies the data voltage for display to the data lines 14A. When sensing driving is performed, the DAC of the data driver IC SDIC may generate a data voltage for sensing in response to a data timing control signal DDC applied by the timing controller 11, and may supply the data voltage for sensing to the data lines 14A.

The data voltage for sensing includes a first data voltage for sensing (hereinafter referred to as a "data voltage for on-driving"), which may on-drive a driving element, and a second data voltage for sensing (hereinafter referred to as a "data voltage for off-driving"), which may off-drive a driving element. The data voltage for on-driving is a voltage that is applied to the gate electrode of a driving element to turn on the driving element (e.g., a voltage to conduct the driving current) upon sensing driving. The data voltage for off-driving is a voltage that is applied to the gate electrode of a driving element to turn off the driving element (e.g., a voltage to cut off the driving current) upon sensing driving. The data voltage for on-driving may be set as a different size in a red (R), green (G), blue (B) or white (W) pixel unit by taking into consideration that a driving characteristic of a driving element/light-emitting device is different for each color.

The data voltage for on-driving is applied to a sensing pixel, that is, the subject of sensing, within one unit pixel. The data voltage for off-driving is applied to non-sensing pixels sharing the sensing line 14B along with a sensing pixel within one unit pixel. For example, in FIG. 2, if the R pixel is sensed and the W, G, and B pixels are not sensed, a data voltage for on-driving may be applied to the driving element of the R pixel, and a data voltage for off-driving may be applied to the driving elements of the respective W, G, and B pixels.

A data voltage for off-driving is also applied to a sensing pixel in addition to a data voltage for on-driving. The data voltage for on-driving may be supplied while a driving current is programmed in the sensing pixel. In other cases, the data voltage for off-driving may be applied to the sensing pixel.

A plurality of the sensing units SU may be mounted on the data driver IC SDIC.

Each of the sensing units SU is connected to the sensing line 14B, and may be selectively connected to an analog-digital converter (hereinafter referred to as an "ADC") through any one of sampling switches SS1 and SS2. Each sensing unit SU may be implemented as a current integrator. Each sensing unit SU is suitable for low current sensing and high-speed sensing because it is implemented in a current sensing type. In other words, if each sensing unit SU is configured in a current sensing type, it is advantageous to reduce the sensing time and improve sensing sensitivity.

The sensing unit SU further includes a multiplexer MUX circuit that switches between the sensing line 14B and the current integrator. In one or more embodiments, the MUX circuit used herein can include a multiplexer as well as a demultiplexer. The term MUX is used in the broadest sense to include any circuitry that is capable of performing a function of a multiple-input, single-output switch, or a single-input, multiple-output switch or in some cases, a multiple-input, multiple-output switch in which the number of inputs are different from the number of outputs, as might occur based on the various circuit designs. The MUX circuit forms a first current path for primarily sensing the amount of charges accumulated in the parasitic capacitor of a light-emitting device and a second current path for secondarily sensing the amount of charges accumulated in the parasitic capacitor. There are thus two paths to sensing the charges in the parasitic capacitor. The sensing unit SU senses a driving characteristic of the light-emitting device twice per pixel through the first current path and the second current path. This is for improving the accuracy of sensing by allowing a driving characteristic value of a light-emitting device to be determined regardless of the amount of charges accumulated in the parasitic capacitor of the light-emitting device. This is described more specifically with reference to FIGS. 4 to 9E.

The ADC may convert a sensing output voltage, output by the sensing unit SU twice per pixel, into sensing result data SDATA, and may output the sensing result data SDATA to the compensation unit 20.

The gate driver 13 may generate gate signals for sensing based on a gate control signal GDC and sequentially supply the gate signals to the gate lines 15 upon sensing driving. The gate signal for sensing is a scan signal for sensing which is synchronized with a data voltage for sensing. Display lines L1~Ln are sequentially subjected to sensing driving by the gate signals for sensing and the data voltages for sensing. In this case, each of the display lines L1~Ln is not a physical signal line, but means that an assembly of R, W, G, and B pixels is adjacent to one another in a horizontal direction.

The gate driver 13 may generate gate signals for display based on a gate control signal GDC and sequentially supply the gate signals to the gate lines 15 upon display driving. The gate signal for display is a scan signal for display, which is synchronized with a data voltage for display. The display lines L1~Ln are sequentially subjected to display driving by the gate signals for display and the data voltages for display.

In one embodiment of the present disclosure, a sensing driving sequence for detecting a driving characteristic of a light-emitting device may be independently performed by the R, W, G or B pixel. For example, in a sensing driving sequence according to an embodiment of the present disclosure, after R pixels are sensed in a line-sequential manner with respect to all the display lines of the display panel 10, W pixels may be sensed in a line-sequential manner. Next, after G pixels are sensed in a line-sequential manner, B pixels may be sensed in a line-sequential manner. In this case, a sensing sequence according to a color may be differently configured.

Figure 4:
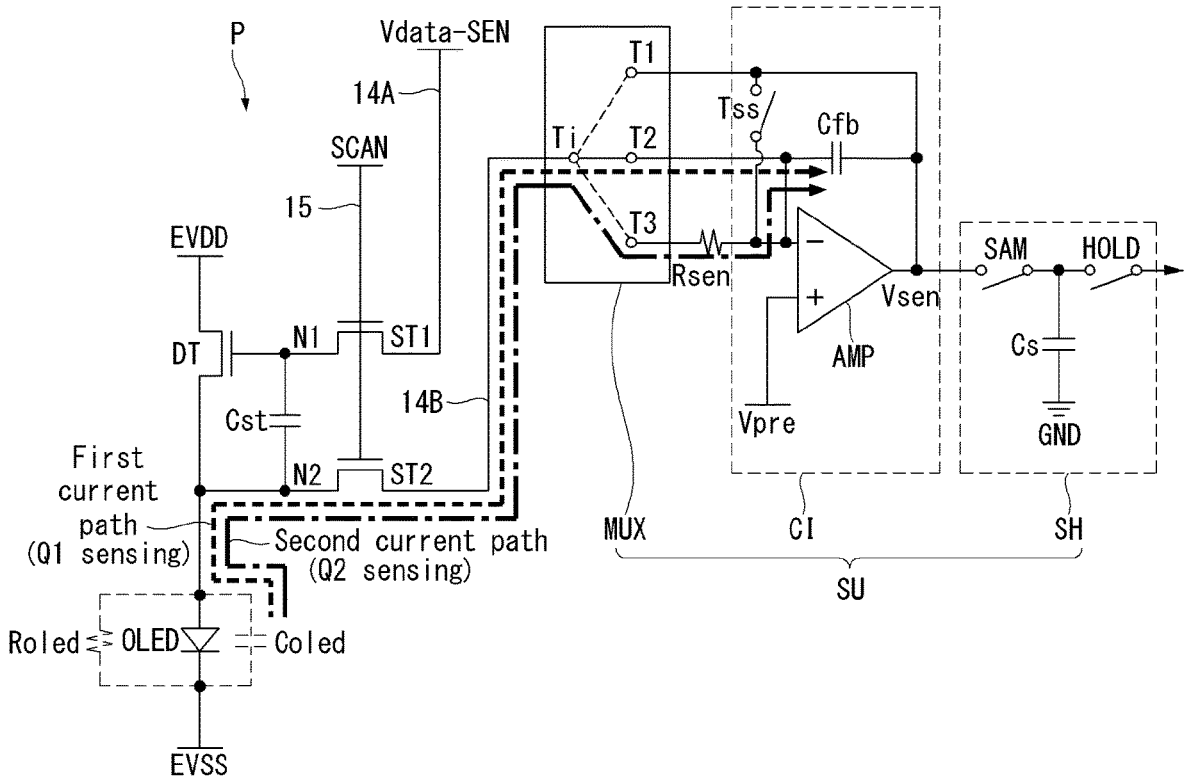
FIG. 4 is a diagram showing an example of the configuration of one pixel and a sensing unit according to an embodiment of the present disclosure.
Figure 5:
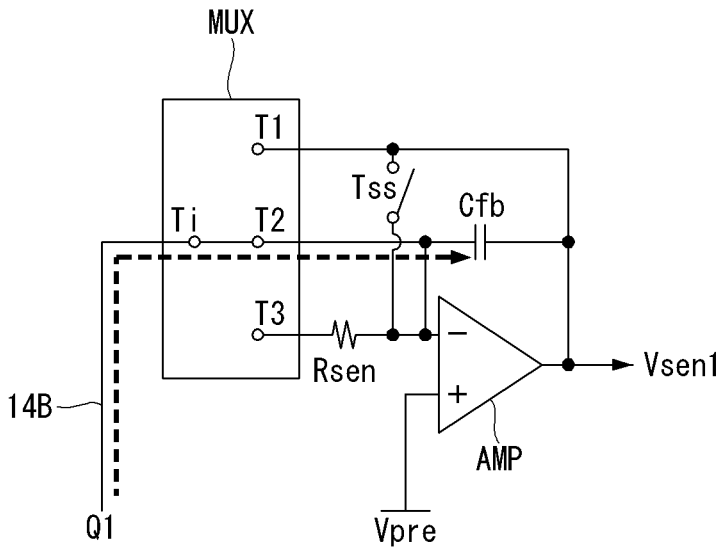
FIG. 5 is a diagram showing a first current path for sensing the amount of charges accumulated in the parasitic capacitor of an OLED.
Figure 6:
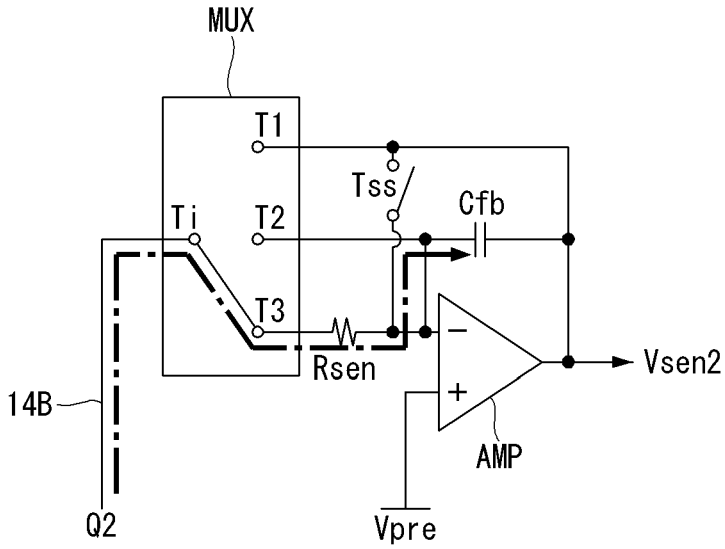
FIG. 6 is a diagram showing a second current path for sensing the amount of charges accumulated in the parasitic capacitor of an OLED.

FIG. 4 is a diagram showing an example of the configuration of the pixel P and the sensing unit SU according to an embodiment of the present disclosure. FIG. 5 is a diagram showing a first current path for sensing the amount of charges accumulated in the parasitic capacitor of an OLED. FIG. 6 is a diagram showing a second current path for sensing the amount of charges accumulated in the parasitic capacitor of an OLED.

Referring to FIG. 4, each pixel P may include an OLED, a driving thin film transistor (TFT) DT, a storage capacitor Cst, a first switch TFT ST1, and a second switch TFT ST2. The TFTs configuring the pixel P may be implemented in a p type or may be implemented in an n type or may be implemented in a hybrid type in which the p type and the n type are mixed. Furthermore, the semiconductor layer of each of the TFTs configuring the pixel P may include amorphous silicon or polysilicon or oxide.

The OLED is a light-emitting element that emits light in response to a driving current. The OLED includes an anode electrode connected to a second node N2, a cathode electrode connected to the input stage of the low potential pixel voltage EVSS, and an organic compound layer positioned between the anode electrode and the cathode electrode. The organic compound layer includes a hole injection layer (HIL), a hole transport layer (HTL), an emission layer (EML), an electron transport layer (ETL), and an electron injection layer (EIL). When a driving voltage is applied between the anode electrode and the cathode electrode, holes passing through the HTL and electrons passing through the ETL move to the EML and thus form excitons. As a result, the EML generates a visible ray.

The driving TFT DT is a driving element that generates a driving current corresponding to a gate-source voltage (e.g., a voltage difference between a gate voltage and a source voltage). The driving TFT DT includes a gate electrode connected to a first node N1, a drain electrode connected to the input stage of the high potential pixel voltage EVDD, and a source electrode connected to the second node N2. The driving TFT DT generates a large driving current as the gate-source voltage increases, and generates a small driving current as the gate-source voltage decreases.

The storage capacitor Cst is connected between the first node N1 and the second node N2 and maintains the gate-source voltage of the driving TFT DT. The first switch TFT ST1 applies a data voltage for sensing Vdata-SEN, charged in a data line 14A, to the first node N1 in response to a gate signal for sensing SCAN. The data voltage for sensing Vdata-SEN includes a data voltage for on-driving and a data voltage for off-driving. The first switch TFT ST1 includes a gate electrode connected to a gate line 15, a drain electrode applied to the data line 14A, and a source electrode connected to the first node N1. The second switch TFT ST2 turns on/off a current flow between the second node N2 and a sensing line 14B in response to the gate signal for sensing SCAN. The second switch TFT ST2 includes a gate electrode connected to the gate line 15, a drain electrode connected to the sensing line 14B, and a source electrode connected to the second node N2.

In each pixel P, the capacity of a parasitic capacitor Coled of the OLED may be different depending on a process deviation or deterioration deviation of the OLED. For example, as OLED deterioration increase, the capacity of the parasitic capacitor Coled of the OLED may be reduced. The threshold voltage of the OLED can be indirectly known by sensing the capacity of the parasitic capacitor Coled of the OLED. A method of sensing the capacity of the parasitic capacitor Coled of the OLED is to sense the amount of charges accumulated in the parasitic capacitor Coled of the OLED in response to a driving current. However, an OLED driving characteristic cannot be determined based on the results of one sensing of the amount of charges of an OLED because the amount of charges of the OLED is influenced by other circuit elements in addition to the OLED as described above. An embodiment of the present disclosure improves the accuracy of sensing so that a driving characteristic value of a light-emitting device is determined regardless of the amount of charges of an OLED by sensing the amount of charges of an OLED twice per pixel through two different current paths.

To this end, the sensing unit SU includes a current integrator CI and a MUX circuit MUX.

The current integrator CI includes an amplifier AMP having a first input terminal (−) connected to a sensing resistor Rsen, a second input terminal (+) to which an amplifier reference voltage Vpre is applied, and an output terminal on which a sensing output voltage Vsen is loaded. Furthermore, the current integrator CI includes a feedback capacitor Cfb having one electrode connected to the first input terminal (−) of the amplifier AMP and the other electrode connected to the output terminal of the amplifier AMP. In some embodiments, the current integrator CI includes a reset switch Tss connected between the first input terminal (−) and the output terminal of the amplifier AMP.

The MUX circuit MUX selectively connects a MUX input terminal Ti to MUX output terminals T1, T2, and T3. The MUX input terminal Ti is connected to the sensing line 14B. The MUX output terminal T1 is connected to the output terminal of the amplifier AMP. The MUX output terminal T2 is connected to one electrode of the feedback capacitor Cfb and the first input terminal (−) of the amplifier AMP. In some embodiments, the MUX output terminal T2 is directly connected to one electrode of the feedback capacitor Cfb and the first input terminal (−) of the amplifier AMP. The MUX output terminal T3 is connected to one electrode of the feedback capacitor Cfb and the first input terminal (−) of the amplifier AMP via the sensing resistor Rsen. In one or more embodiments, the MUX output terminal T1 is selectively connected to the first input terminal (−) of the amplifier AMP according to the operation of the reset switch Tss. For example, when the reset switch Tss is ON (e.g., enabled, connected), the output terminal T1 is connected both to the first input terminal (−) of the amplifier AMP and the output terminal of the amplifier AMP. On the other hand, when the reset switch Tss is OFF (e.g., disabled, disconnected), the output terminal T1 is connected the output terminal of the amplifier AMP but is disconnected to the first input terminal (−) of the amplifier AMP.

The MUX circuit MUX forms a first current path for primarily sensing the amount of charges accumulated in the parasitic capacitor Coled of the OLED as much as Q1 and a second current path for secondarily sensing the amount of charges as much as Q2.

When the first current path for sensing the amount of charges Q1 is formed as in FIG. 5, the MUX input terminal Ti and the MUX output terminal T2 are connected. The sensing resistor Rsen is not included in the first current path. Accordingly, all the amount of charges Q1 accumulated in the parasitic capacitor Coled of the OLED is accumulated in the feedback capacitor Cfb of the current integrator CI due to the characteristic of current that flows to a lower resistor. The current integrator CI outputs the results of the accumulation of the amount of charges Q1, that is, a first sensing output voltage Vsen1. In this configuration, the reset switch Tss may be switched OFF.

When the second current path for forming the amount of charges Q2 is formed as in FIG. 6, the MUX input terminal Ti and the MUX output terminal T3 are connected. The sensing resistor Rsen is included in the second current path. Accordingly, a current distribution occurs between an OLED internal resistor Roled and the sensing resistor Rsen that are connected in parallel. The amount of charges Q2 corresponding to some of the amount of charges Q1 accumulated in the parasitic capacitor Coled of the OLED is accumulated in the feedback capacitor Cfb of the current integrator CI due to the current distribution. The current integrator CI outputs the results of the accumulation of the amount of charges Q2, that is, a second sensing output voltage Vsen2. In this configuration, the reset switch Tss is switched OFF.

Upon a first initialization and OLED charging before the first current path is formed and upon a second initialization and OLED charging before the second current path is formed, the MUX input terminal Ti and the MUX output terminal T1 are connected. The first initialization operation and the second initialization operation mean that the sensing line 14B and the source electrode node (e.g., second node) of the driving TFT DT are initialized to the amplifier reference voltage Vpre prior to OLED charging. The OLED charging means that charges are accumulated in the parasitic capacitor Coled of the OLED in response to a driving current received from the driving TFT DT. The driving TFT DT generates a driving current in response to a data voltage for on-driving from among the data voltage for sensing Vdata-SEN.

The sensing unit SU according to an embodiment of the present disclosure may further include a sample and hold unit SH configured to sequentially sample and hold the first sensing output voltage Vsen1 and the second sensing output voltage Vsen2 output by the current integrator CI and to output the sensing output voltages to the ADC. The sample and hold unit SH includes a sampling switch SAM and a holding switch HOLD connected between the current integrator CI and the ADC in series and a sampling capacitor Cs connected between a node between the switches SAM and HOLD and a ground voltage source GND.

Figure 7:
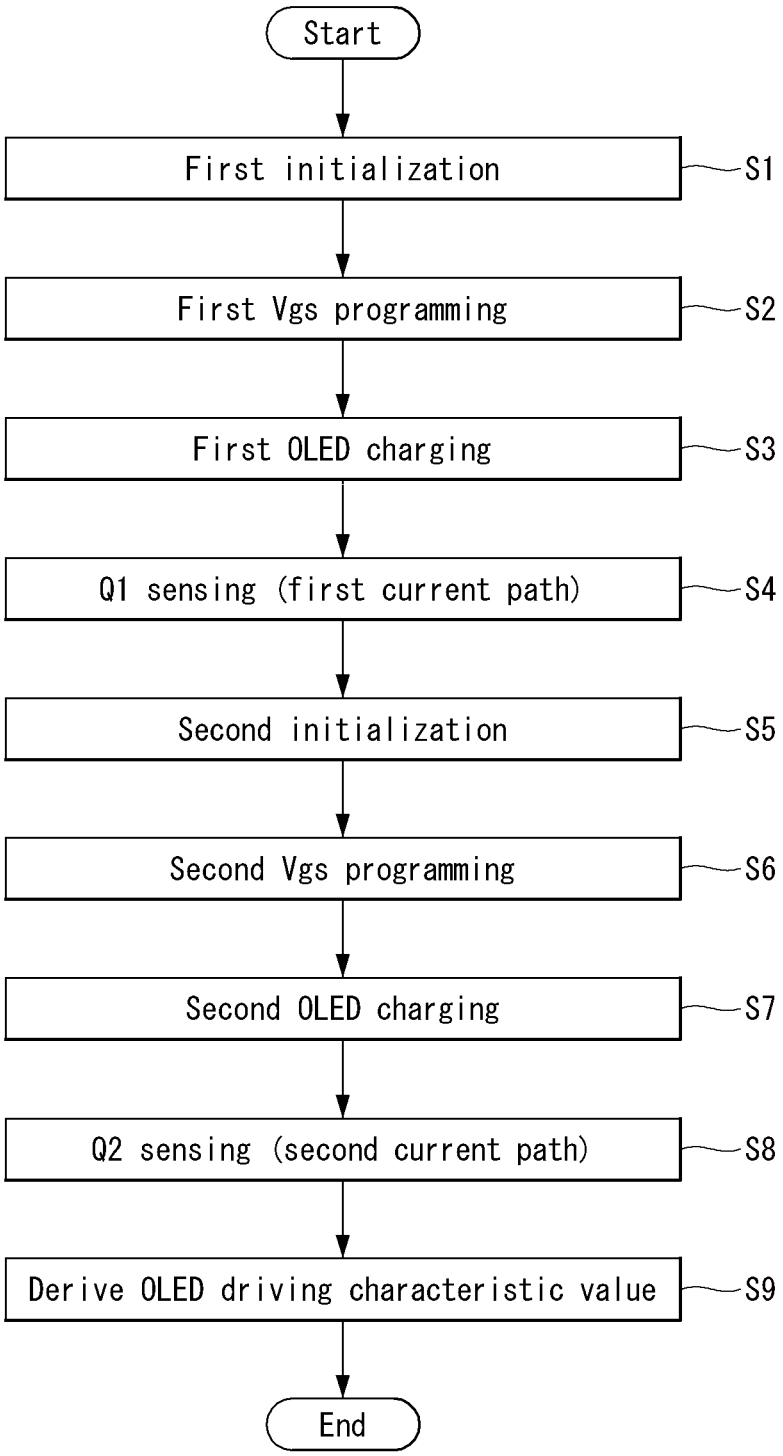
FIG. 7 is a diagram showing a method of sensing a pixel of the organic light-emitting display device according to an embodiment of the present disclosure.
Figure 8:
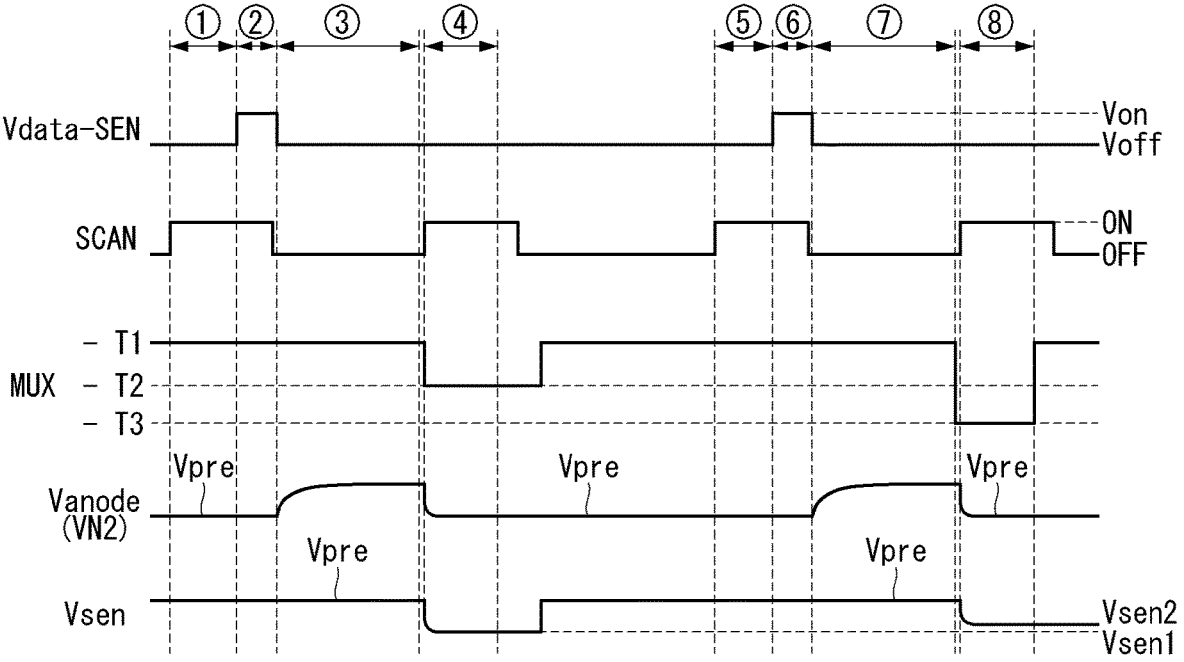
FIG. 8 shows driving waveforms of the pixel and the sensing unit, which correspond to S1~S8 of FIG. 7.
Figure 9A:
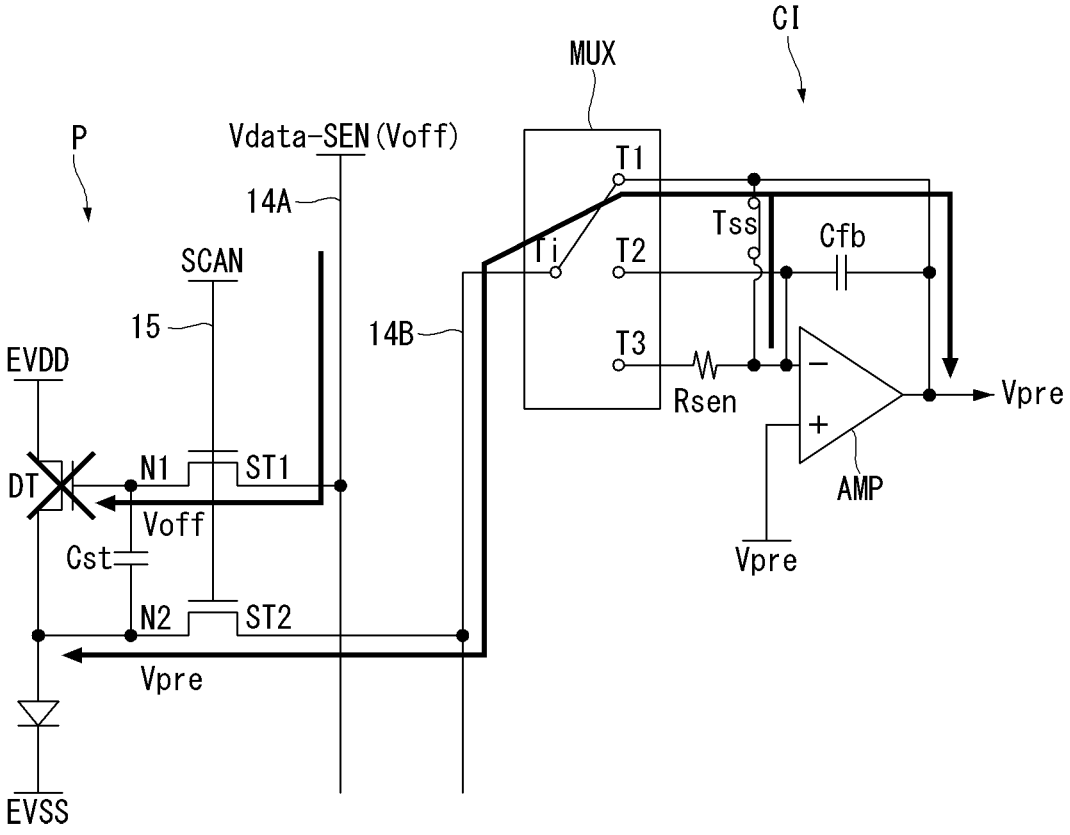
FIG. 9A is an equivalent circuit diagram showing an operation of the pixel and the sensing unit in periods ① and ⑤ of FIG. 8.
Figure 9B:
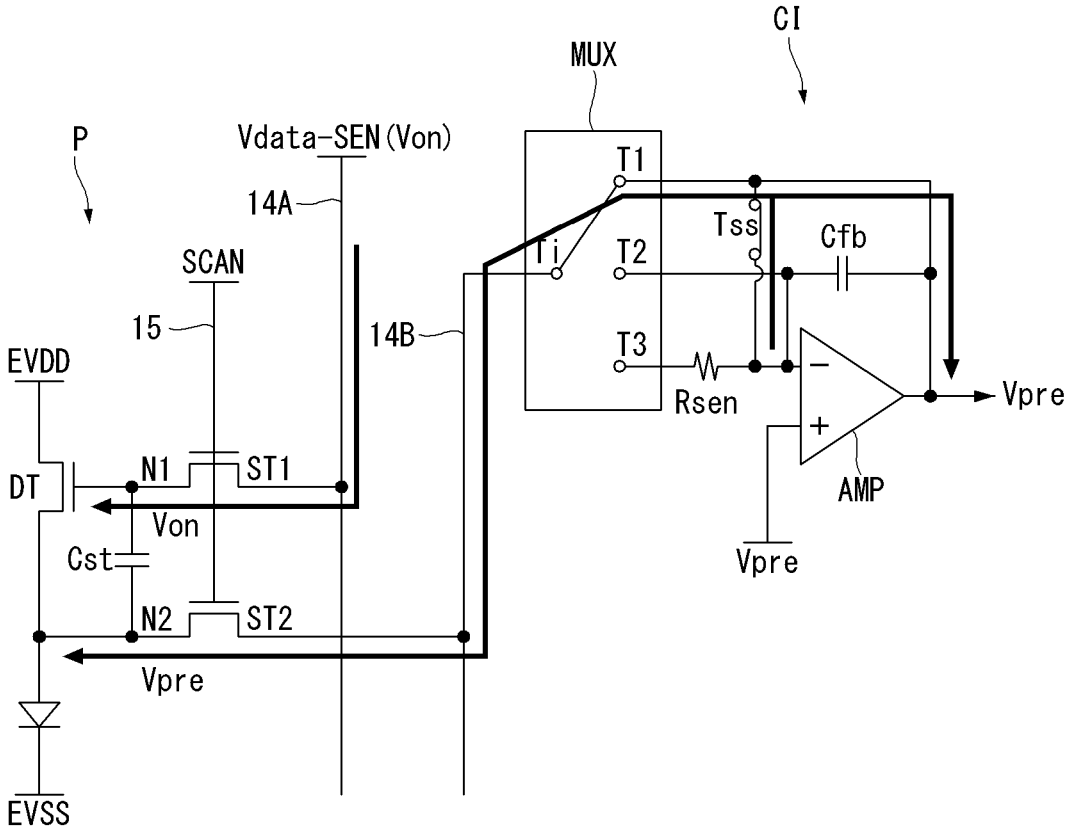
FIG. 9B is an equivalent circuit diagram showing an operation of the pixel and the sensing unit in periods ② and ⑥ of FIG. 8.
Figure 9C:
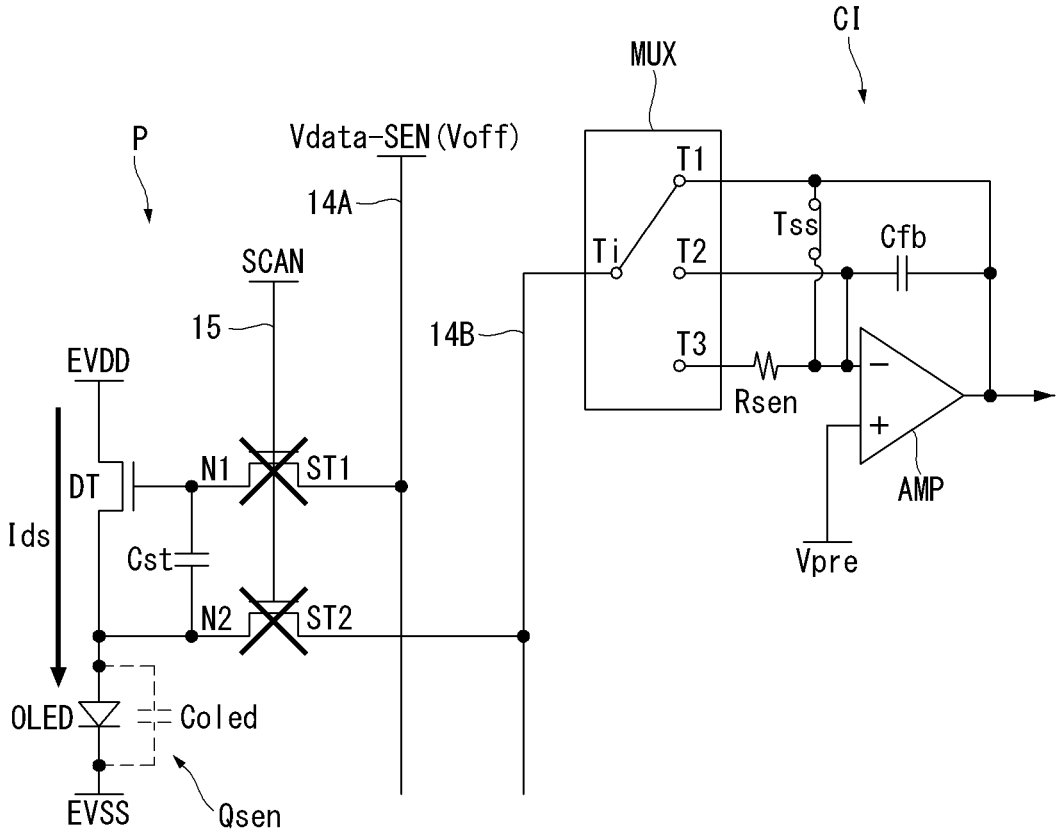
FIG. 9C is an equivalent circuit diagram showing an operation of the pixel and the sensing unit in periods ③ and ⑦ of FIG. 8.

FIG. 7 is a diagram showing a method of sensing a pixel of the organic light-emitting display device according to an embodiment of the present disclosure. FIG. 8 shows driving waveforms of the pixel and the sensing unit, which correspond to S1~S8 of FIG. 7. FIG. 9A is an equivalent circuit diagram showing an operation of the pixel and the sensing unit in periods ① and ⑤ of FIG. 8. FIG. 9B is an equivalent circuit diagram showing an operation of the pixel and the sensing unit in periods ② and ⑥ of FIG. 8. FIG. 9C is an equivalent circuit diagram showing an operation of the pixel and the sensing unit in periods ③ and ⑦ of FIG.

Figure 9D:
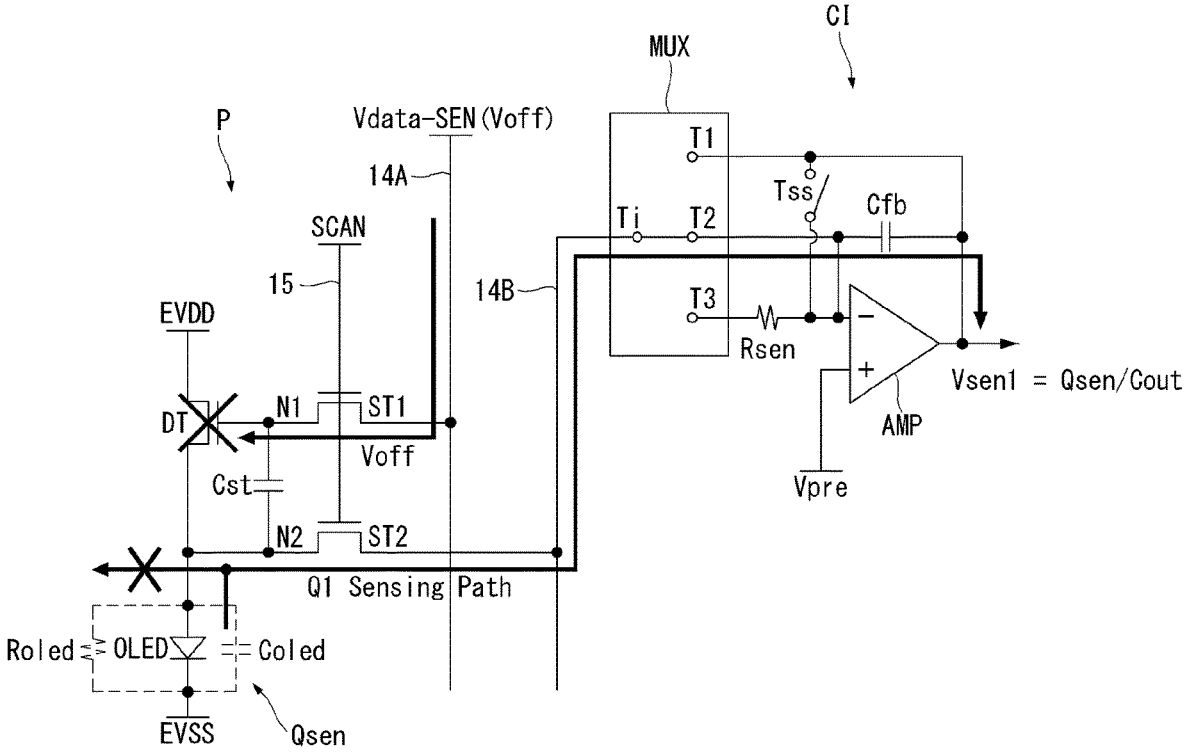
FIG. 9D is an equivalent circuit diagram showing an operation of the pixel and the sensing unit in a period ④ of FIG. 8.
Figure 9E:
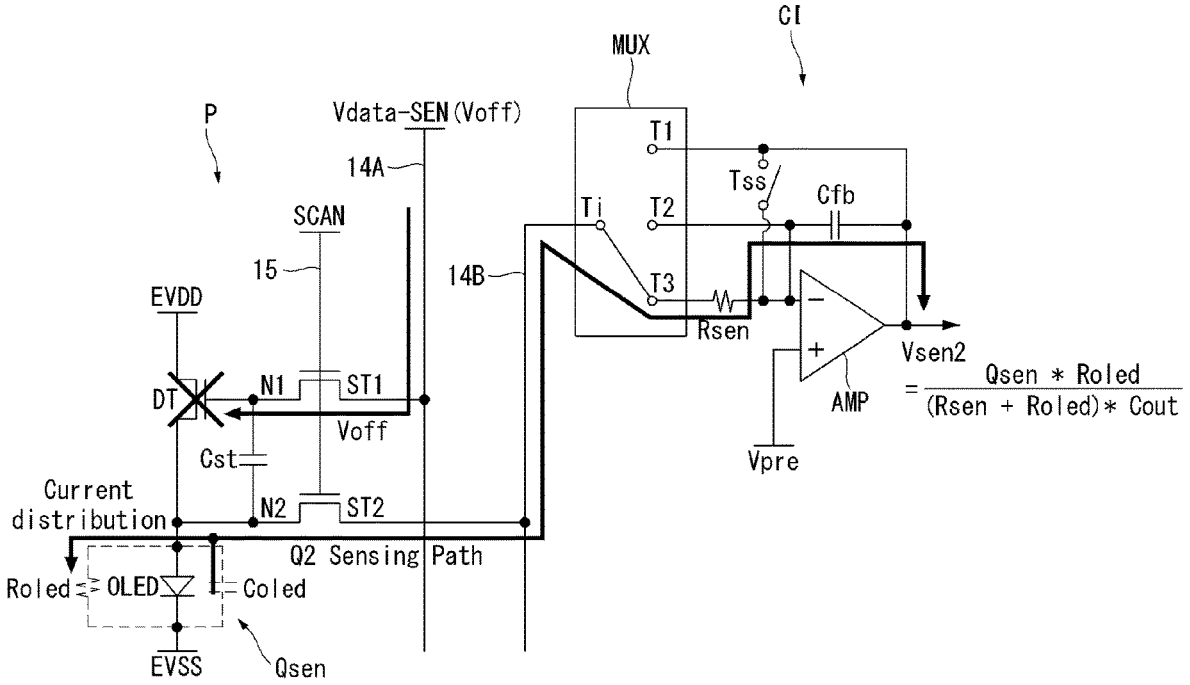
FIG. 9E is an equivalent circuit diagram showing an operation of the pixel and the sensing unit in a period ⑧ of FIG. 8.

8. FIG. 9D is an equivalent circuit diagram showing an operation of the pixel and the sensing unit in a period ④ of FIG. 8. FIG. 9E is an equivalent circuit diagram showing an operation of the pixel and the sensing unit in a period ⑧ of FIG. 8. In the figures, an X on a circuit or a current flow path indicates it is disabled at that particular time.

Referring to FIGS. 7, 8 and 9A, in the first initialization period ①, the first and second switches TFTs ST1 and ST2 of the pixel P are turned on in response to a gate signal for sensing SCAN having an on level, and the MUX input terminal Ti and MUX output terminal T1 of the MUX circuit MUX are connected, and the reset switch Tss of the current integrator CI is turned on. In the first initialization period ①, the output terminal of the amplifier AMP, the sensing line 14B, and the second node N2 of the pixel P are initialized to the amplifier reference voltage Vpre (S1). Furthermore, the first node N1 of the pixel P is charged with a data voltage for off-driving Voff, so the driving TFT DT is turned off. In the first initialization period ①, the voltage Vanode of the anode electrode of the OLED and the sensing output voltage Vsen become the amplifier reference voltage Vpre.

Referring to FIGS. 7, 8 and 9B, in the first Vgs programming period ②, the first and second switches TFTs ST1 and ST2 of the pixel P and the reset switch Tss of the current integrator CI maintain a turn-on state, and the connection state is maintained between the MUX input terminal Ti and MUX output terminal T1 of the MUX circuit MUX. At this time, the data voltage for sensing Vdata-SEN is charged into the first node N1 as a data voltage for on-driving Von, and the voltage VN2 of the second node N2 maintains the amplifier reference voltage Vpre. In the first Vgs programming period ②, a gate-source voltage Von-Vpre capable of turning on the driving TFT DT is set (S2). In the first Vgs programming period ②, the voltage Vanode of the anode electrode of the OLED and the sensing output voltage Vsen maintain the amplifier reference voltage Vpre.

Referring to FIGS. 7, 8 and 9C, in the first OLED charging period ③, the first and second switches TFTs ST1 and ST2 of the pixel P are turned off, and the connection state is maintained between the MUX input terminal Ti and MUX output terminal T1 of the MUX circuit MUX. At this time, a magnitude of the gate-source voltage of the driving TFT DT is maintained constant by the storage capacitor Cst of the pixel P. In the first OLED charging period ③, the driving TFT DT is turned on to generate a driving current Ids. The parasitic capacitor Coled of the OLED accumulates the driving current Ids received from the driving TFT DT (S3). The amount of charges Qsen accumulated in the parasitic capacitor Coled of the OLED is proportional to the capacity of the parasitic capacitor Coled. In the first OLED charging period ③, the voltage Vanode of the anode electrode of the OLED is booted up to the operating point voltage of the OLED, and the OLED emits light. At this time, the sensing output voltage Vsen maintains the amplifier reference voltage Vpre. Meanwhile, in the first OLED charging period ③, when the voltage VN2 of the second node N2, which is the voltage of the anode electrode of the OLED, is boosted, the voltage VN1 of the first node N1 is also boosted by the coupling effect of the storage capacitor Cst. Thus, the gate-source voltage difference of the driving TFT DT in step S3 is kept the same as that in step S2.

Referring to FIGS. 7, 8 and 9D, in the Q1 sensing period ④, the first and second switches TFTs ST1 and ST2 of the pixel P are turned on, and the reset switch Tss of the current integrator CI is turned off, and the MUX input terminal Ti and MUX output terminal T2 of the MUX circuit MUX are connected so that the first current path is formed. At this time, the data voltage for sensing Vdata-SEN is applied to the first node N1 as a data voltage for off-driving Voff, thus turning off the driving TFT DT. Thus, in the Q1 sensing period ④, the amount of charges Qsen accumulated in the parasitic capacitor Coled of the OLED moves to the feedback capacitor Cfb of the current integrator CI along the first current path (e.g., Q1 sensing path), and is stored in the feedback capacitor Cfb. At this time, a current distribution operation does not occur because the sensing resistor Rsen is not included in the first current path. That is, the amount of charges Qsen accumulated in the parasitic capacitor Coled of the OLED does not move to the terminal of the low potential pixel voltage EVSS through the OLED internal resistor Roled, but Q1 corresponding to all the amount of charges Qsen is stored in the feedback capacitor Cfb of the current integrator CI. In the Q1 sensing period ④, the sensing output voltage Vsen gradually drops from the amplifier reference voltage Vpre and becomes a first sensing output voltage Vsen1 corresponding to Q1 (S4). The first sensing output voltage Vsen1 becomes Qsen/Cout. In this case, Cout is the capacity of the feedback capacitor Cfb. The first sensing output voltage Vsen1 is converted into first sensing result data by the ADC via the sample and hold unit, and is then output to the compensation unit 20. In the Q1 sensing period ④, the voltage Vanode of the anode electrode of the OLED drops by Q1 from the operating point voltage of the OLED.

Referring to FIGS. 7, 8 and 9A, in one embodiment, the operation of the second initialization period ⑤ is substantially the same as that of the first initialization period ①. In the second initialization period ⑤, the output terminal of the amplifier AMP, the sensing line 14B, and the second node N2 of the pixel P are initialized to the amplifier reference voltage Vpre again (S5).

Referring to FIGS. 7, 8 and 9B, in one embodiment, the operation of the second Vgs programming period ⑥ is substantially the same as that of the first Vgs programming period ②. In the second Vgs programming period ⑥, a second gate-source voltage Von-Vpre capable of turning on the driving TFT DT is set (S6).

Referring to FIGS. 7, 8 and 9C, in one embodiment, the operation of the second OLED charging period ⑦ is substantially the same as that of the first OLED charging period ③. In the second OLED charging period ⑦, the parasitic capacitor Coled of the OLED accumulates a driving current Ids received from the driving TFT DT (S7).

Referring to FIGS. 7, 8 and 9E, in the Q2 sensing period ⑧, the first and second switches TFTs ST1 and ST2 of the pixel P are turned on, and the MUX input terminal Ti and MUX output terminal T3 of the MUX circuit MUX are connected so that the second current path is formed. At this time, the data voltage for sensing Vdata-SEN is applied to the first node N1 as a data voltage for off-driving Voff, thus turning off the driving TFT DT. In the Q2 sensing period ⑧, the amount of charges Qsen accumulated in the parasitic capacitor Coled of the OLED moves to the feedback capacitor Cfb of the current integrator CI along the second current path (e.g., Q2 sensing path), and is stored in the feedback capacitor Cfb. At this time, a current distribution operation occurs because the sensing resistor Rsen is included in the first current path. That is, some of the amount of charges Qsen accumulated in the parasitic capacitor Coled of the OLED moves to the terminal of the low potential pixel voltage EVSS through the OLED internal resistor Roled, and Q2 corresponding to some of the amount of charges Qsen is stored in the feedback capacitor Cfb of the current integrator CI. In the Q2 sensing period ⑧, the sensing output voltage Vsen gradually drops from the amplifier reference voltage Vpre and becomes a second sensing output voltage Vsen2 corresponding to Q2 (S8). The second sensing output voltage Vsen2 becomes (Qsen*Roled)/[(Rsen+Roled)*Cout]. In this case, Cout is the capacity of the feedback capacitor Cfb. The second sensing output voltage Vsen2 is converted into second sensing result data by the ADC via the sample and hold unit, and is then output to the compensation unit 20. In the Q2 sensing period ⑧, the voltage Vanode of the anode electrode of the OLED drops by Q2 from the operating point voltage of the OLED.

Referring to FIG. 7, the compensation unit 20 derives a driving characteristic value of the OLED by dividing the second sensing result data, corresponding to the second sensing output voltage Vsen2, by the first sensing result data corresponding to the first sensing output voltage Vsen1. The driving characteristic value of the OLED is determined as "Roled/(Rsen+Roled)." The accuracy of sensing is greatly improved because "Roled/(Rsen+Roled)" is not affected by other circuit elements unlike "Qsen."

In one aspect of the present disclosure, a sensing circuit is provided. The sensing circuit includes an amplifier having a non-inverting input terminal, inverting input terminal, and an output terminal. The sensing circuit further includes a feedback capacitor connected to the output terminal and at least one of the non-inverting input terminal and the inverting input terminal. The sensing circuit further includes a sensing resistor being connected to the input terminal of the amplifier connected to the feedback capacitor.

In one embodiment, the sensing circuit is configured to: for a first sensing period, form a first sensing path including the feedback capacitor and the output terminal; and for a second sensing period, form a second sensing path including the feedback capacitor, the output terminal, and the sensing resistor.

In one embodiment, the sensing circuit further includes a multiplexer having an input terminal and a first, second, third output terminals, wherein the input terminal of the multiplexer is connected with a light emitting diode via a sensing line, wherein the light emitting diode is connected to a parasitic capacitor and an internal resistor in parallel.

In one embodiment, during the first sensing period, the multiplexer connects the input terminal to the first output terminal that is connected to the feedback capacitor, and during the second sensing period, the multiplexer connects the input terminal to the second output terminal that is connected to the sensing resistor.

In one embodiment, the sensing circuit is configured to: output a first sensing output voltage during the first sensing period by, sensing total charges along the first sensing path; sensing total capacitance along the first sensing path; and determining the first sensing output voltage based on the total charges and the total capacitance.

In one embodiment, the sensing circuit is configured to: output a second sensing output voltage during the second sensing period by, sensing total charges along the second sensing path; sensing total capacitance along the second sensing path; and determining the second sensing output voltage based on the total charges and the total capacitance.

In one embodiment, the sensing circuit is configured to: determine a characteristic of the light emitting diode based on the first sensing output voltage and the second sensing output voltage.

In one embodiment, the characteristic of the light emitting diode based on the first sensing output voltage and the second sensing output voltage is determined based on a ratio of the sensing resistor and the internal resistor.

In another aspect of the present disclosure, a method of sensing a characteristic value of a light emitting diode within a display device is provided. The sensing method includes: providing a reference voltage from an integrator to an anode of the light emitting diode through a sense line during a first time period to initialize the light emitting diode; providing a data signal through a data line to turn on a driving transistor during a second time period; providing a driving signal to the light emitting diode via the driving transistor connected to the anode of the light emitting diode during the second time period; charging a parasitic capacitor of the light emitting diode during a third time period; forming a first sensing path connecting the parasitic capacitor, the sense line, and a feedback capacitor of the integrator during a fourth time period; charging the feedback capacitor with the parasitic capacitor during the fourth time period; and sensing a first amount of charge that was stored on the feedback capacitor during the fourth time period. The method may be performed by a data driver circuit connected to the display panel of the display device.

In one embodiment, the anode of the light emitting diode maintains the reference voltage during the first and second time period.

In one embodiment, the step of providing a reference voltage from an integrator to an anode of the light emitting diode through a sense line during a first time period to initialize the light emitting diode includes: turning on a reset switch connected to the integrator to discharge the feedback capacitor; providing the reference voltage to an output terminal of the integrator; and connecting the sense line with the output terminal of the integrator via a multiplexer circuit.

In one embodiment, the driving signal includes a driving current flowing into the light emitting diode.

In one embodiment, the step of charging a parasitic capacitor of the light emitting diode during a third time period includes: applying a gate signal to a first switching transistor connected to the driving transistor to disable the first switching transistor; applying the gate signal to a second switching transistor connected to the anode of the light emitting diode to disable the second switching transistor; and providing the driving signal to the parasitic capacitor to accumulate charge in the parasitic capacitor.

In one embodiment, the step of forming a first sensing path connecting the parasitic capacitor, the sense line, a feedback capacitor of the integrator during a fourth time period includes: connecting the sense line with an input of a multiplexer circuit; connecting a first output of the multiplexer circuit to the feedback capacitor of the integrator; applying the gate signal to the second switching transistor to enable the second switching transistor; and applying the data signal to the driving transistor to disable the driving transistor.

In one embodiment, the first sensing path does not include an internal resistor of the light emitting diode.

In one embodiment, the sensing method further includes: providing the reference voltage of the integrator to the anode of the light emitting diode through the sense line during a fifth time period to initialize the light emitting diode; providing the driving signal to the light emitting diode via the driving transistor connected to the anode of the light emitting diode during the sixth time period; charging the parasitic capacitor of the light emitting diode during the seventh time period; forming a second sensing path connecting an internal resistor of the light emitting diode, the parasitic capacitor, the sense line, the sensing resistor, and the feedback capacitor of the integrator during an eighth period; and charging the feedback capacitor with the parasitic capacitor during the eighth period; sensing a second amount of charge on the feedback capacitor during the eighth time period.

In one embodiment, the internal resistor is connected in parallel to the parasitic capacitor of the light emitting diode.

In one embodiment, the step of forming a second sensing path connecting an internal resistor of the light emitting diode, the parasitic capacitor, the sense line, the sensing resistor, and the feedback capacitor of the integrator during an eighth period includes: connecting the sense line with an input of a multiplexer circuit; connecting a second output of the multiplexer circuit to the sensing resistor of the integrator; applying the gate signal to the second switching transistor to enable the second switching transistor; and applying the data signal to the driving transistor to disable the driving transistor.

In one embodiment, the sensing method further includes: determining a first value based on the first amount of charge along the first sensing path; determining a second value based on the second amount of charge along the second sensing path; calculating the characteristic value of the light emitting diode based on a ratio of the first value and the second value.

In one embodiment, the characteristic value is based on a ratio of the internal resistor and the sensing resistor.

In one embodiment, the characteristic value of the light emitting diode is a value of the internal resistor divided by the sum of a value of the internal resistor and the sensing resistor.

As described above, the present disclosure generates a first sensing output voltage and a second sensing output voltage by sensing the amount of charges, stored in the parasitic capacitor of an OLED, twice using the first current path not including the sensing resistor and the second current path including the sensing resistor. The present disclosure derives a driving characteristic value of an OLED for each pixel by dividing second sensing result data, corresponding to the second sensing output voltage, by first sensing result data corresponding to the first sensing output voltage.

Accordingly, the present disclosure can greatly improve the accuracy of sensing by excluding the influence of other circuit elements in sensing a driving characteristic value of an OLED. Furthermore, the present disclosure can prevent excessive compensation/insufficient compensation and greatly enhance compensation performance by improving the accuracy of sensing.

Those skilled in the art will understand that the present disclosure may be changed and modified in various ways without departing from the technical spirit of the present disclosure through the above-described contents. Accordingly, the technological scope of the present disclosure is not limited to the contents described in the detailed description of the specification, but should be determined by the claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a light emitting diode configured to emit light, the light emitting diode having an anode, a cathode, an internal resistor and a parasitic capacitor;

a multiplexer circuit having an input connected to an anode of the light emitting diode;

an amplifier having an inverting terminal, a non-inventing terminal, and an output terminal;

a feedback capacitor having a first plate and a second plate, the second plate being coupled to an output terminal of the amplifier;

a first output of the multiplexer circuit selectively connectable to the first plate;

a second output of the multiplexer circuit selectively connectable to the inverting terminal;

a sensing resistor positioned in a series path between the second output of the multiplexer circuit and the inverting terminal; and a third output of the multiplexer circuit selectively connectable to the output terminal of the amplifier, wherein a driving characteristic value of the light emitting diode is determined based on a ratio of the internal resistor and the sensing resistor.

2. The display device of claim 1, wherein the driving characteristic value of the light emitting diode is a value of the internal resistor divided by the sum of a value of the internal resistor and the sensing resistor.

3. The display device of claim 1, wherein the feedback capacitor and the amplifier operates as an integrator.

4. The display device of claim 3, wherein the non-inverting terminal of the amplifier is connected to a reference voltage.

5. The display device of claim 1, further comprising:

a reset switch connected to the inverting terminal and the output terminal;

a first switching transistor having a first gate electrode, a first source electrode, and a first drain electrode;

a second switching transistor having a second gate electrode, a second source electrode, and a second drain electrode;

a gate line connected to the first gate electrode of the first switching transistor and to the second gate electrode of the second switching transistor;

a data line connected to a first drain electrode of the first switching transistor;

a sensing line connected to a second drain electrode of the second switching transistor and the input of the multiplexer circuit;

a driving transistor connected to the light emitting diode and the first source electrode of the first switching transistor;

a storage capacitor connected between the first source electrode of the first switching transistor and the second source electrode of the second switching transistor;

a first sensing path including the light emitting diode, the second switching transistor, and the feedback capacitor, wherein the second switching transistor is connected to the first output of the multiplexer circuit during a period while the first sensing path is formed; and a second sensing path including the light emitting diode, the second switching transistor, the sensing resistor and the feedback capacitor, wherein the second switching transistor is connected to the second output of the multiplexer circuit during a period while the second sensing path is formed.

6. The display device of claim 5, wherein the gate line is configured to provide scan signals to the first and second switching transistors, the data line is configured to provide data voltage to the driving transistor, the sensing line is configured to connect to at least one of the first, second, and third output of the multiplexer circuit based on different time periods.

7. The display device of claim 6, further comprising:

a data driver circuit configured to:

provide a reference voltage from the amplifier to an anode of the light emitting diode through the sense line during a first time period to initialize the light emitting diode;

provide a data signal through the data line to turn on the driving transistor during a second time period;

provide a driving signal to the light emitting diode via the driving transistor connected to the anode of the light emitting diode during the second time period;

charge a parasitic capacitor of the light emitting diode during a third time period;

form the first sensing path connecting the parasitic capacitor of the light emitting diode, and the feedback capacitor during a fourth time period;

charge the feedback capacitor with the parasitic capacitor during the fourth time period; and sense a first amount of charge that was stored on the feedback capacitor during the fourth time period.

8. The display device of claim 7, wherein the anode of the light emitting diode maintains the reference voltage during the first and second time period.

9. The display device of claim 8, wherein provide a reference voltage from the amplifier to an anode of the light emitting diode through the sense line during a first time period to initialize the light emitting diode includes:

turning on the reset switch connected to the amplifier to discharge the feedback capacitor;

providing the reference voltage to the output terminal of the amplifier; and connecting the sense line with the output terminal of the amplifier via the multiplexer circuit.

10. The display device of claim 8, wherein the driving signal includes a driving current flowing into the light emitting diode.

11. The display device of claim 8, wherein charge a parasitic capacitor of the light emitting diode during a third time period includes:

applying a gate signal to the first switching transistor connected to the driving transistor to disable the first switching transistor;

applying the gate signal to the second switching transistor connected to the anode of the light emitting diode to disable the second switching transistor; and providing the driving signal to the parasitic capacitor to accumulate charge in the parasitic capacitor.

12. The display device of claim 11, wherein forming the first sensing path does not include the internal resistor of the light emitting diode.

13. The display device of claim 8, wherein form a first sensing path connecting the parasitic capacitor, the sense line, a feedback capacitor of the integrator during a fourth time period includes:

connecting the sense line with the input of the multiplexer circuit;

connecting the first output of the multiplexer circuit to the feedback capacitor of the amplifier;

applying the gate signal to the second switching transistor to enable the second switching transistor; and applying the data signal to the driving transistor to disable the driving transistor.

14. The display device of claim 7, wherein the data driver circuit is further configured to:

provide the reference voltage of the amplifier to the anode of the light emitting diode through the sense line during a fifth time period to initialize the light emitting diode;

provide the driving signal to the light emitting diode via the driving transistor connected to the anode of the light emitting diode during the sixth time period;

charge the parasitic capacitor of the light emitting diode during the seventh time period;

form the second sensing path connecting the internal resistor of the light emitting diode, the parasitic capacitor, the sensing resistor, and the feedback capacitor of the amplifier during an eighth period;

charge the feedback capacitor with the parasitic capacitor during the eighth period; and sense a second amount of charge on the feedback capacitor during the eighth time period.

15. The display device of claim 14, wherein form a second sensing path connecting an internal resistor of the light emitting diode, the parasitic capacitor, the sensing resistor, and the feedback capacitor of the integrator during an eighth period includes:

connecting the sense line with the input of a multiplexer circuit;

connecting the second output of the multiplexer circuit to the sensing resistor of the amplifier;

applying the gate signal to the second switching transistor to enable the second switching transistor; and applying the data signal to the driving transistor to disable the driving transistor.

16. The display device of claim 15, wherein the data driver circuit is further configured to:

determine a first value based on the first amount of charge along the first sensing path;

determine a second value based on the second amount of charge along the second sensing path; and calculate the characteristic value of the light emitting diode based on a ratio of the first value and the second value.

17. The display device of claim 1, further comprising:

a sample and hold circuit including:

a sampling switch connected to the output terminal of the amplifier;

a holding switch connected to the sampling switch; and a sampling capacitor connected between the sampling switch and the holding switch.

18. The display device of claim 17, further comprising:

an analog-to-digital converter connected to an output of the sample and hold circuit; and a compensation circuit connected to the analog-to-digital converter, wherein the compensation unit determines a driving characteristic value of the light emitting diode by dividing a value of the internal resistor divided by the sum of a value of the internal resistor and the sensing resistor.

19. The display device of claim 18, wherein the compensation unit determines the data voltage to compensate for a brightness deviation based on the determined driving characteristic value of the light emitting diode.

20. A display device comprising:

a light emitting diode configured to emit light, the light emitting diode having an anode, a cathode, an internal resistor and a parasitic capacitor;

a multiplexer circuit having an input connected to an anode of the light emitting diode;

an amplifier having an inverting terminal, a non-inventing terminal, and an output terminal;

a feedback capacitor having a first plate and a second plate, the second plate being coupled to an output terminal of the amplifier;

a first output of the multiplexer circuit selectively connectable to the first plate;

a second output of the multiplexer circuit selectively connectable to the inverting terminal;

a sensing resistor positioned in a series path between the second output of the multiplexer circuit and the inverting terminal;

a third output of the multiplexer circuit selectively connectable to the output terminal of the amplifier, a reset switch connected to the inverting terminal and the output terminal;

a first switching transistor having a first gate electrode, a first source electrode, and a first drain electrode;

a second switching transistor having a second gate electrode, a second source electrode, and a second drain electrode;

a gate line connected to the first gate electrode of the first switching transistor and to the second gate electrode of the second switching transistor;

a data line connected to a first drain electrode of the first switching transistor;

a sensing line connected to a second drain electrode of the second switching transistor and the input of the multiplexer circuit;

a driving transistor connected to the light emitting diode and the first source electrode of the first switching transistor;

a storage capacitor connected between the first source electrode of the first switching transistor and the second source electrode of the second switching transistor;

a first sensing path including the light emitting diode, the second switching transistor, and the feedback capacitor, wherein the second switching transistor is connected to the first output of the multiplexer circuit during a period while the first sensing path is formed; and a second sensing path including the light emitting diode, the second switching transistor, the sensing resistor and the feedback capacitor, wherein the second switching transistor is connected to the second output of the multiplexer circuit during a period while the second sensing path is formed.

* * * * *